United States Patent [19]

Shumaker

[11] 4,026,428

[45] May 31, 1977

[54] STABILIZER ATTACHMENT FOR MATERIAL HANDLING IMPLEMENT

[75] Inventor: John F. Shumaker, Mount Pleasant, Iowa

[73] Assignee: J. I. Case Company, Racine, Wis.

[22] Filed: Oct. 28, 1975

[21] Appl. No.: 626,262

[52] U.S. Cl. ..... 214/138 R; 212/145; 214/140; 280/765

[51] Int. Cl.² ..... E02F 9/00

[58] Field of Search ..... 214/78, 138 R, 140; 212/145; 280/763, 764, 765

[56] References Cited

UNITED STATES PATENTS

| | | | |
|---|---|---|---|
| 2,641,370 | 6/1953 | Pherson | 214/78 |
| 3,096,887 | 7/1963 | Thomas | 212/145 |
| 3,144,138 | 8/1964 | Brown et al. | 212/145 |
| 3,193,110 | 7/1965 | Bamford | 212/145 |
| 3,362,548 | 1/1968 | Cunningham | 212/145 X |
| 3,606,048 | 9/1971 | Long | 214/138 |
| 3,780,877 | 12/1973 | Levitt | 212/145 X |
| 3,831,774 | 8/1974 | Moore | 212/145 |

*Primary Examiner*—L. J. Paperner
*Attorney, Agent, or Firm*—Dressler, Goldsmith, Clement, Gordon & Shore, Ltd.

[57] ABSTRACT

A stabilizer attachment for the front end of a material handling vehicle is disclosed herein. The stabilizer attachment consists of a frame that is directly attached to the front end of the vehicle chassis and has stabilizer feet which are moved into ground engaging positions by two separately controlled fluid rams.

8 Claims, 5 Drawing Figures

STABILIZER ATTACHMENT FOR MATERIAL HANDLING IMPLEMENT

BACKGROUND OF THE INVENTION

One type of material handling unit that has found a remarkable degree of commercial success is what is commonly referred to as a loader backhoe unit. A loader backhoe unit consists of a vehicle that includes a chassis frame and pneumatic tires which support the chassis frame. The chassis frame has a backhoe unit supported on the rear end thereof and a loader unit on the forward end. The backhoe unit on the rear end generally consists of a boom having a dipper stick assembly pivotally supported on the outer end thereof with a bucket pivoted on the outer end of the dipper stick assembly. Normally, the boom and dipper stick assembly are of substantial length so that the bucket can be moved a substantial distance from the rear end of the vehicle.

The loader unit on the forward end of the vehicle generally consists of a pair of elongated lift arms that are pivotally supported on opposite sides of the chassis frame intermediate the opposite ends thereof with the forward ends of arms extending forwardly beyond the chassis frame and a bucket pivotally supported on the outer ends of the lift arms.

Generally this type of vehicle also includes stabilizing means adjacent the rear end of the vehicle for raising the rear or driving wheels off the ground during the use of the vehicle as a backhoe unit. These generally consist of a pair of stabilizer arms respectively pivotally supported on the rear end of the chassis frame and moved from retracted to extended positions by fluid rams.

These vehicles are generally operated in extremely rough terrain and as such, it has become customary to support the front wheels on an axle which is pivoted about a longitudinal pivot axis on the center of the forward end of the chassis frame. Such an arrangement has resulted in substantially reducing the stability of the vehicle, particularly when the vehicle backhoe unit is being operated. Thus, in order to increase the stability of the unit during the backhoe operation, operators generally lower the loader bucket to engage the ground and many times will utilize the loader bucket and pivot arms to raise the front wheels off the ground. However, such an arrangement has been found to be less than totally satisfactory for several reasons. Utilizing the front end mounted bucket loader as a stabilizer induces stresses into the loader arm causing premature failure. In addition, as indicated above, the operation of the unit is normally done in extremely uneven terrain and the bucket, which is usually at least equal to the width of the vehicle, has no means to compensate for such uneven terrain or ground conditions.

SUMMARY OF THE INVENTION

According to the present invention, the problem of premature failure of the loader arms is eliminated by providing a separate stabilizing means on the forward end of the vehicle which is capable of readily compensating for uneven ground conditions and which, cooperating with the rear stabilizers, will maintain the chassis frame in a fixed position. The stabilizing means on the forward end of the vehicle is designed so as not to interfere with the operation of the loader bucket in either the extended or retracted positions.

More specifically, the stabilizer attachment for the front end of a vehicle includes a stabilizer frame secured directly to the front end of the chassis frame between the loader arms with a pair of stabilizer feet respectively adapted to be retracted and extended by fluid ram means. The stabilizer means includes support means between the stabilizer frame and the respective feet and a pair of fluid rams cooperating with the stabilizer means and the support means for moving the stabilizer feet between extended and retracted positions.

In one embodiment of the invention, the support means consists of a transversely extending hollow member with first and second members telescopically received in opposite ends of the hollow member and the feet are connected to the outer ends of the respective members. In this embodiment, a pair of fluid rams are interposed between the stabilizer frame and the hollow tube and are transversely spaced from each other and individually controlled so that the angular position of the transversely extending hollow tubular member can be positioned to compensate for uneven ground conditions.

In the second embodiment of the invention, the support means consists of a pair of rigid links each of which has one end pivotally connected to the stabilizer frame and the respective feet are pivoted on the opposite ends of the respective links with a pair of fluid rams interposed between the respective links and the stabilizer frame so that each stabilizer foot can be separately moved between extended and retracted positions.

Detailed Description

Figure 1:
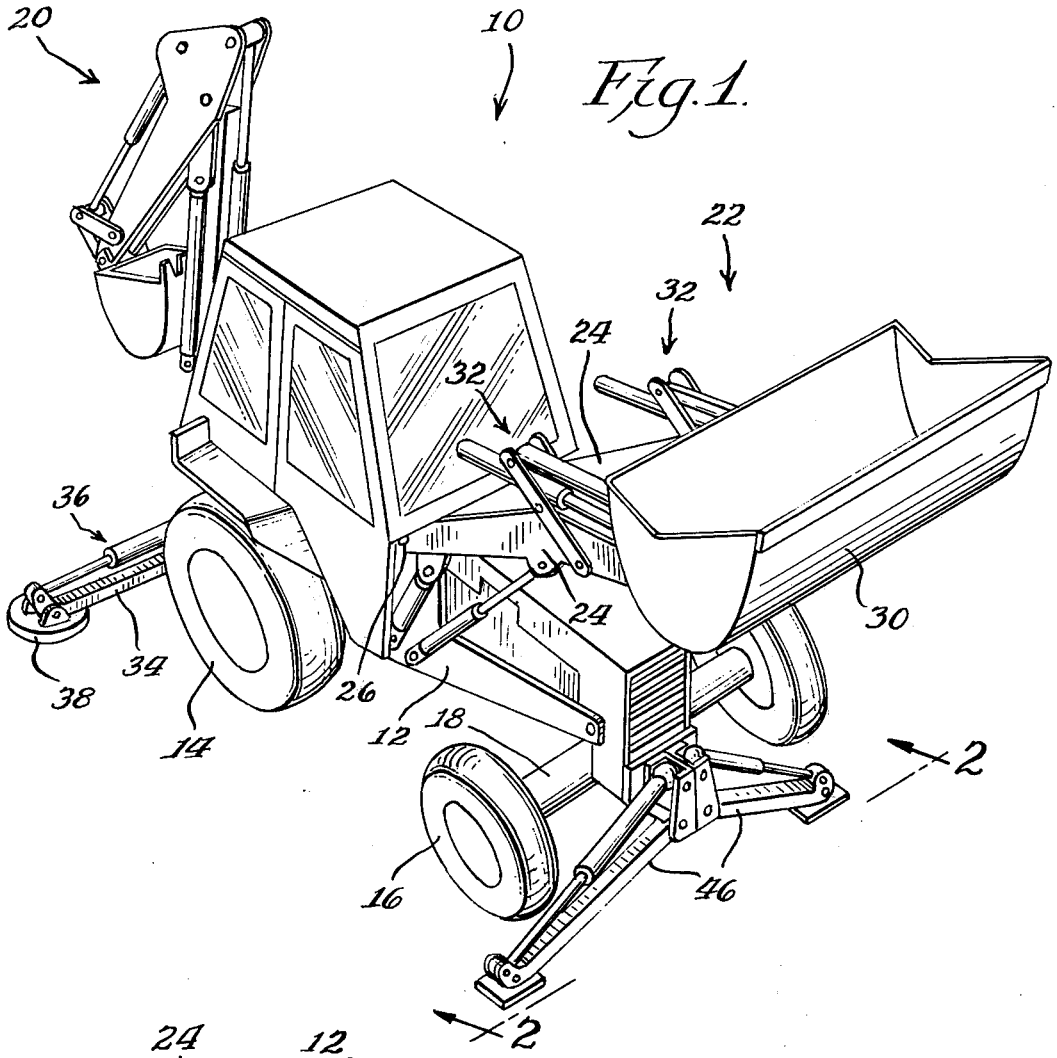
FIG. 1 shows a perspective view of a vehicle having the stabilizer attachment of the present invention secured thereto.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings shows a vehicle, generally designated by the reference numeral 10. Vehicle 10 has an elongated chassis frame 12 which is supported at the rear end by a pair of drive wheels 14 and at the forward ends by a pair of steering wheels 16. As is customary in this type of vehicle, front wheels 16 are supported on a transversely extending axle 18 that is pivoted about a pivot that is located along the longitudinal center of the vehicle or chassis frame 12.

A backhoe unit 20 is supported on the rear end of chassis frame 12. The backhoe unit may be of the type disclosed in Long, U.S. Pat. No. 3,047,171.

A loader unit 22 is supported on the front end of the vehicle and consists of a pair of lift or loader arms 24 that extend along opposite sides of chassis frame 12 and have their inner ends pivoted on pivot pins 26 located intermediate the opposite ends of chassis frame 12. The opposite or outer ends of loader arms 24 have a bucket 30 pivotally supported thereon and moved through a fluid ram and linkage system 32.

Vehicles of the type described above have been available commercially for many years and usually include a pair of stabilizer arms 34 pivoted at their inner ends to the rear end of the chassis frame with the pivotal movement being produced by fluid rams 36 and stabilizing feet 38 supported on the outer end of stabilizer arms 34.

As indicated above, when the backhoe unit is being utilized for a digging operation, it has been standard procedure for the operator to extend the stabilizers on the rear end of the vehicle and to lower the bucket on the forward end to engage the ground and act as the stabilizing means for the vehicle. However, as indicated above, such operation substantially decreases the service life of the bucket loader and results in substantial maintenance costs.

According to the present invention, these problems are eliminated by utilizing a separate attachment for the forward end of the vehicle which can be moved between extended and retracted positions and provide the desired stability for the forward end of the vehicle. The stabilizer attachment is designed so as not to interfere with the operation of the bucket loader either in the extended or the retracted positions.

Figure 2:
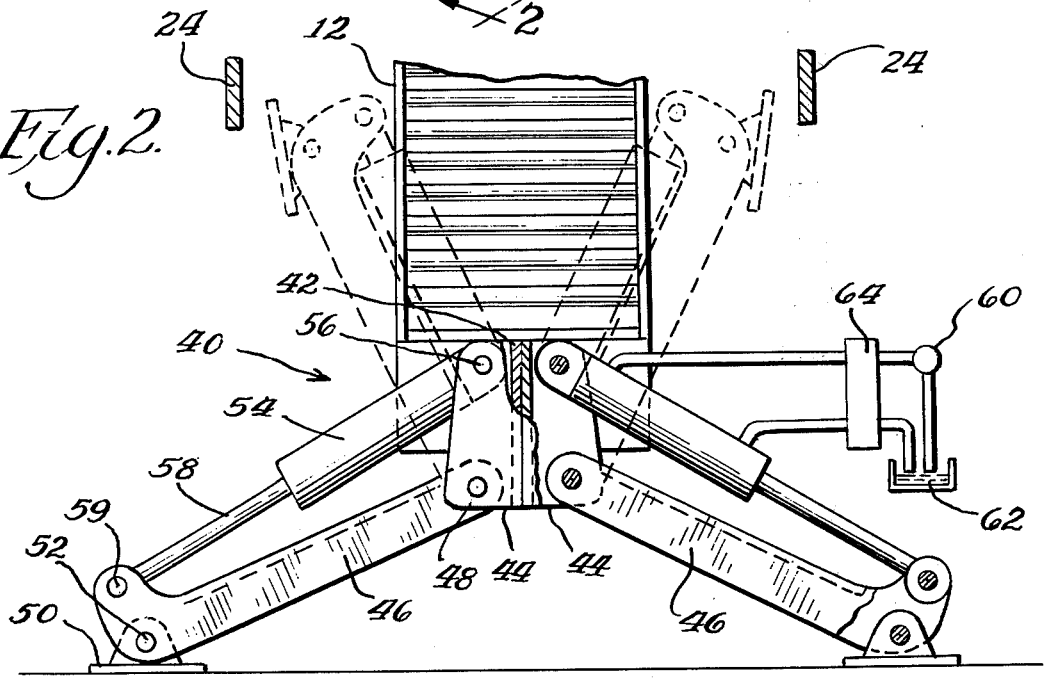
FIG. 2 is a front end view of the vehicle shown in FIG. 1, as viewed along line 2—2 of FIG. 1, showing the details of one form of stabilizer attachment.

FIG. 2 of the drawings discloses a first type of stabilizer means 40 consisting of a stabilizer frame 42 secured to the forward lower end of vehicle chassis 12 and transversely centered with respect to the chassis. Stabilizer frame 42 consists of a pair of U-shaped brackets 44 that may be secured directly to the chassis frame such as by welding or by utilizing suitable bolts. Each U-shaped bracket 44 supports a rigid stabilizer link 46 that is pivoted thereon by a pivot pin 48. A stabilizer foot 50 is pivotally supported on the outer end of the rigid link 46 by a pivot pin 52.

Rigid links 46 are independently pivoted between extended and retracted positions, respectively shown in solid and phantom lines in FIG. 2 by a fluid ram including a cylinder or first element 54 pivoted on frame 42 by a pivot pin 56 and a piston rod or second element 58 pivoted on the outer end of rigid link 46 through a pivot pin 59. The respective fluid rams are of the double acting type and each has pressurized fluid supplied thereto from a pump 60 and a reservoir 62 through a separate control valve 64 (only one being shown). Thus, the respective positions of the stabilizer feet 50 with respect to chassis frame can be accurately controlled to compensate for uneven terrain. As can be seen from an inspection of FIG. 2, the pivotal connections for the respective links and fluid ram elements are in close proximity to the longitudinal center of the vehicle. With this arrangement, the stabilizer arms and feet can be moved to a retracted position which is located within loader arms 24 so as not to obstruct the operation of loader 22 when a stabilizer attachment is in either the extended or the retracted position.

Figure 3:
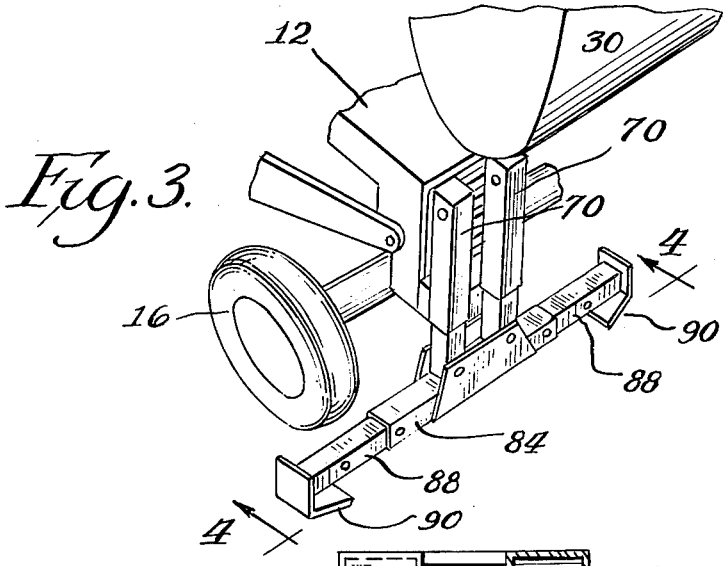
FIG. 3 is a fragmentary view similar to FIG. 1 showing a second type of stabilizer attachment.
Figure 4:
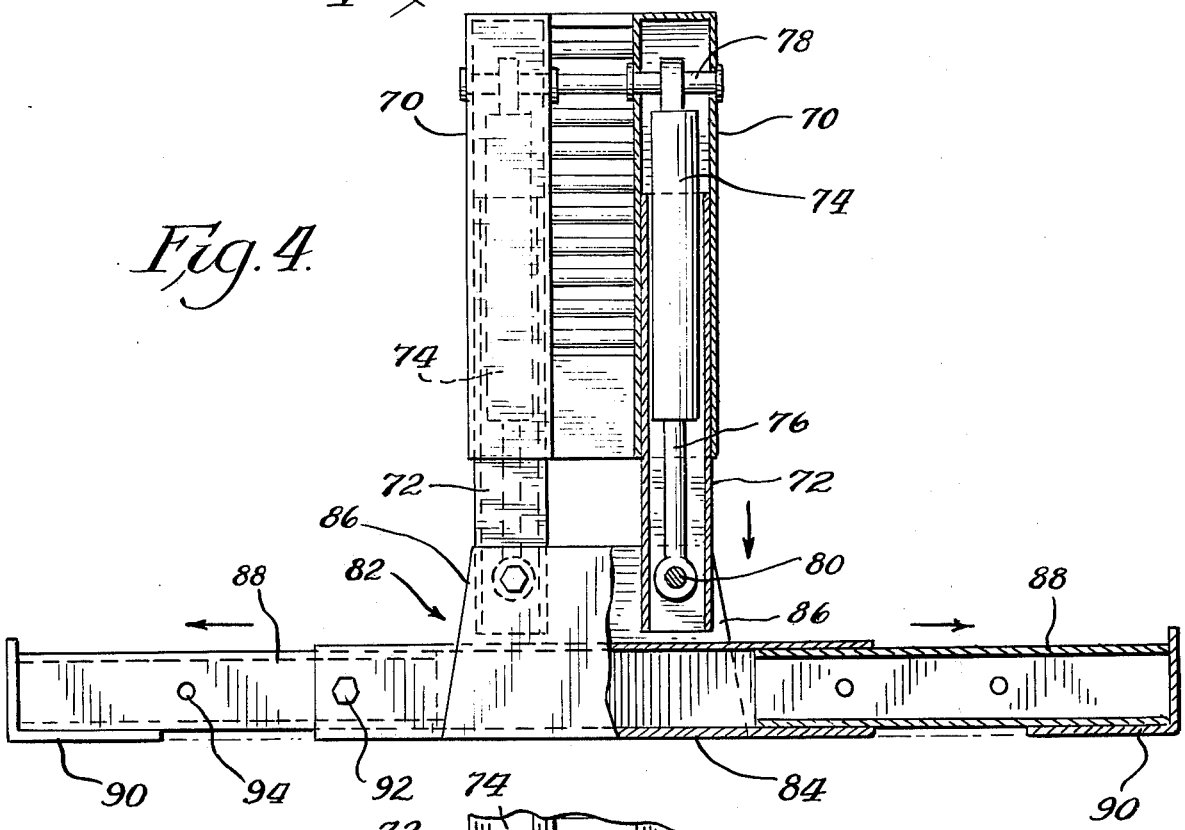
FIG. 4 is a front end view of the second stabilizer attachment, as viewed along line 4—4 of FIG. 3.
Figure 5:
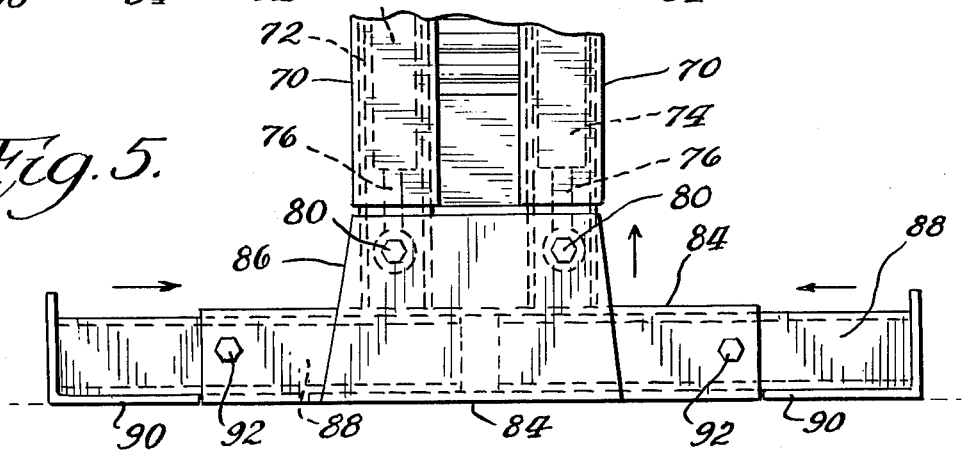
FIG. 5 is a view similar to FIG. 4 showing the stabilizer attachment in a retracted position.

A slightly modified form of the invention is disclosed in FIGS. 3 through 5 wherein the stabilizer frame and support means consists of first and second hollow members 70 respectively secured to vehicle chassis frame 12 and equally spaced on opposite sides of the longitudinal center of the vehicle. The lower ends of the rectangular hollow members 70 are open and telescopingly receive corresponding rectangular members 72. A pair of fluid rams each including a cylinder or first element 74 and a piston rod or second element 76 are located within telescoping members 70 and 72 and each cylinder 74 is connected by pin 78 to an outer telescoping member 70 while the piston rod 76 is pivotally connected by pin 80 to the inner telescoping member 72. Piston rods 76 and inner telescoping members 72 are also pivotally connected to a subframe 82 consisting of a transversely extending hollow rectangular member 84 and a pair of plates 86. In the illustrated embodiment, pins 80 define the pivotal connection for both the telescoping members 72 and plates 86.

The opposite end of hollow rectangular telescoping members 84 each receive a further pair of rectangular telescoping members 88 which respectively support ground engaging feet 90 at the outer ends thereof. The two telescoping members 88 may be manually moved inwardly or outwardly with respect to hollow tubular member 84 and held in a plurality of adjusted positions by bolts 92 extending through openings 94.

As in the previous embodiment, the respective fluid rams have pressurized fluid supplied thereto, the flow of which is independently controlled by suitable valves.

In the embodiment illustrated in FIGS. 3, 4 and 5, the stabilizer means is moved to an extended ground engaging position by initially moving telescoping members 88 from the position illustrated in FIG. 5 to that position illustrated in FIG. 4 wherein stabilizer feet 90 are located a substantial distance outside wheels 16. Bolts 92 are then inserted in the appropriate holes or openings 94 to hold telescoping members 84 and 88 in an extended position with respect to each other. The respective control valves are then manipulated so that the fluid rams are independently extended until the respective feet 90 are in engagement with the ground. By utilizing separate controls for supplying fluid to the respective fluid rams, the angular position of the hollow member 84 may be changed with respect to the transverse axis of the vehicle to compensate for uneven terrain. In the embodiment illustrated in FIGS. 3–5, the telescoping members 70 and 72 act as guide means between chassis frame 12 and subframe 82 and also enclose and protect the cylinders 74 and piston rods 76 from damage by rocks or other debris. As in the previous embodiment, the telescoping members 70 and 72 are located within the transverse confines of chassis frame 12, as indicated in FIG. 4 and the horizontal members 84 and 88 are at all times located below the chassis frame 12 so as not to interfere with the operation of loader bucket 30 in either the extended or the retracted positions for the respective stabilizer feet 90.

Of course, it will be appreciated that while stabilizer feet 90 have been illustrated as being rigidly secured to members 88, these could readily be pivotally supported thereon adjacent the lower walls and extend downwardly a sufficient distance to accommodate uneven terrain between the respective ground engaging feet.

As can be appreciated from the above description, the stabilizing attachment of the present invention can readily be supplied as a separate unit and attached to the chassis of an existing vehicle. Furthermore, the elements are all designed and interrelated so that the operation of the vehicle is not affected in either position of the stabilizing means.

While no power means has been shown for moving telescoping members 88 inwardly and outwardly with respect to hollow member 84, it will be appreciated that power means, such as a rack and pinion arrangement or a fluid ram could readily be utilized for producing such movement.

What is claimed is:

1. A vehicle having an elongated chassis frame with rear wheels supporting a rear end of said chassis frame and front wheels on opposite sides of said chassis supporting a front end of said chassis frame, a first material handling implement extending beyond said front end, said implement including a pair of arms each having one end pivoted on respective sides of said chassis frame intermediate opposite ends thereof with a material handling unit pivotally supported on opposite ends of said arms, rear stabilizer means supported on said rear end of said chassis frame, a second material handling implement pivotally supported on said rear end of said chassis frame, a separate front stabilizer frame secured directly to said chassis frame at said front end between said arms, a pair of stabilizer feet carried by said frame and respectively adapted to extended transversely beyond said front wheels, support means supporting said feet on said stabilizer frame and fluid ram means cooperating with said stabilizer frame and said support means for moving said feet between an extending ground engaging position and a retracted position above the ground.

2. A vehicle as defined in claim 1, in which said support means includes a transversely extending hollow member with first and second members telescopically received in opposite ends of said hollow member with said feet respectively carried on outer free ends of said first and second members.

3. A vehicle as defined in claim 2, in which said fluid ram means includes first and second transversely spaced fluid rams with each fluid ram having one element secured to said stabilizer frame and a second element pivotally supported on said hollow member.

4. A vehicle as defined in claim 3, further including guide means between said stabilizer frame and said hollow member, said guide means surrounding said fluid rams and guiding the relative movement of said fluid rams along a fixed path.

5. A vehicle as defined in claim 1, in which said support means includes a pair of rigid links each having one end pivoted on said stabilizer frame with said feet respectively pivoted on the opposite ends of said links and in which said fluid ram means includes first and second fluid rams each having one element pivoted on said stabilizer frame and a second elements being respectively pivotally connected to the respective links.

6. A vehicle having an elongated chassis frame with rear wheels supporting a rear end of said chassis frame and front wheels on opposite sides of said chassis supporting a front end of said chassis frame, a first material handling implement extending beyond said front end, said implement including a pair of implement arms each having one end pivoted on respective sides of said chassis frame intermediate opposite ends thereof with a material handling unit pivotally supported on opposite ends of said implement arms, rear stabilizer means on said rear end of said chassis frame, a second material handling implement pivotally supported on said rear end of said chassis frame, a front stabilizer frame secured directly to said frame on said front end between said arms, a pair of stabilizer arms respectively pivoted on said stabilizer frame between extended and retracted positions, a pair of stabilizer feet secured to free ends of said stabilizer feet, and fluid ram means between said stabilizer frame and the respective arms for pivoting said stabilizer arms between said extending position and said retracted position above the ground said stabilizer arms and feet being located between said implement arms in said retracted position.

7. A vehicle having an elongated chassis frame with rear wheels supporting a rear end of said chassis frame and front wheels on opposite sides of said chassis supporting a front end of said chassis frame, a first material handling implement extending beyond said front end, rear stabilizer means supported on said rear end of said chassis frame, a second material handling implement pivotally supported on said rear end of said chassis frame, a front stabilizer frame secured directly to said chassis frame on said front end, a generally horizontal hollow member extending generally transverse adjacent the front end of said chassis frame, a pair of telescoping members supported in said hollow member and extending from opposite ends thereof, a pair of stabilizer feet respectively connected to free ends of said telescoping members, support means between said stabilizer frame and hollow member for moving said hollow member between raised and lowered positions, said telescoping members being extendable and retractable with respect to said hollow member to change the position of said feet with respect to said chassis frame.

8. A vehicle as defined in claim 7, in which said support means includes a first and second transversely spaced pairs of hollow telescoping members between said stabilizer frame and said generally horizontal member and first and second transversely spaced fluid rams respectively within said pairs of hollow telescoping members with each fluid ram having one element secured to said stabilizer frame and a second element pivotally supported on said generally horizontal hollow member.

* * * * *

UNITED STATES PATENT AND TRADEMARK OFFICE

CERTIFICATE OF CORRECTION

PATENT NO. : 4,026,428

DATED : May 31, 1977

INVENTOR(S) : JOHN F. SHUMAKER

It is certified that error appears in the above-identified patent and that said Letters Patent are hereby corrected as shown below:

Column 4, line 17, "end" should read --ends--.

Column 5, line 23, after "to" insert --be--.

Column 5, line 52, "elements" should read --element--, and after "element" insert --, said second elements--.

Column 6, line 12, insert --chassis-- before "frame".

Column 6, line 19, after "ground" add a comma.

Signed and Sealed this

*Twentieth* Day of *September 197*

[SEAL]

*Attest:*

RUTH C. MASON
*Attesting Officer*

LUTRELLE F. PARKER
*Acting Commissioner of Patents and Trademark*